United States Patent [19]

Fu

[11] 4,011,153

[45] Mar. 8, 1977

[54] LIQUEFACTION AND DESULFURIZATION OF COAL USING SYNTHESIS GAS

[75] Inventor: Yuan C. Fu, Bethel Park, Pa.

[73] Assignee: The United States of America as represented by the United States Energy Research and Development Administration, Washington, D.C.

[22] Filed: Apr. 1, 1975

[21] Appl. No.: 564,182

[52] U.S. Cl. ..... 208/10

[51] Int. Cl.[2] ..... C10G 1/08

[58] Field of Search ..... 208/10

[56] References Cited

UNITED STATES PATENTS

| | | | |
|---|---|---|---|
| 3,687,838 | 8/1972 | Seitzer | 208/10 |
| 3,694,342 | 9/1972 | Sprow et al. | 208/10 |
| 3,796,650 | 3/1974 | Urban | 208/10 |
| 3,808,119 | 4/1974 | Bull et al. | 208/8 |
| 3,819,506 | 6/1974 | Seitzer et al. | 208/8 |
| 3,840,456 | 10/1974 | Yavorsky et al. | 208/10 |
| 3,846,275 | 11/1974 | Urban | 208/10 |
| 3,909,390 | 9/1975 | Urban | 208/10 |
| 3,920,536 | 11/1975 | Seitzer et al. | 208/10 |
| 3,926,775 | 12/1975 | Schroeder | 208/10 |
| 3,930,984 | 1/1976 | Pitchford | 208/10 |

*Primary Examiner*—Delbert E. Gantz
*Assistant Examiner*—James W. Hellwege
*Attorney, Agent, or Firm*—Dean E. Carlson; Arthur A. Churm; James W. Weinberger

[57] ABSTRACT

A process for desulfurizing and liquefying coal by heating said coal at a temperature of 375°–475° C in the presence of a slurry liquid, hydrogen, carbon monoxide, steam, and a catalyst comprising a desulfurization catalyst and an alkali metal salt.

4 Claims, No Drawings

LIQUEFACTION AND DESULFURIZATION OF COAL USING SYNTHESIS GAS

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to the desulfurization and liquefaction of coal. More specifically, this invention relates to a catalytic process for the desulfurization and liquefaction of coal which uses inexpensive synthesis gas.

Recent petroleum and natural gas shortages and environmental problems underline the great importance of developing alternative sources of clean energy in this country. While vast resources of coal are available, it is not as attractive as a source of energy because of its physical and chemical properties. Because coal is a solid which contains considerable ash, it is inconvenient and expensive to transport and utilize. Furthermore, much of the coal available contains relatively high concentrations of sulfur which, upon combustion, is released to the atmosphere as a pollutant unless recovered by expensive equipment before dispersal.

Considerable effort is now being expended to develop processes to desulfurize and liquefy the coal to form a carbonaceous liquid product which can either be used as a fuel oil or processed further to produce additional petroleum products. One such process for the desulfurization and liquefaction of coal is described in U.S. Pat. No. 3,840,456. However, this process and similar processes either require or prefer that carbon-monoxide-free gas be used with the process to obtain desirable results. However, hydrogen which is free of carbon monoxide is expensive and in short supply, since it is generally produced by the reaction of steam with a hydrocarbon source such as natural gas or coal to produce a synthesis gas. The synthesis gas as produced is an admixture of carbon monoxide, some carbon dioxide and hydrogen. This "raw" synthesis gas is then passed through a shift converter to produce the carbon dioxide and additional hydrogen. Since the gas still contains about 3% residual carbon monoxide, further processing will be required before the gas can be used with a carbon-monoxide-sensitive catalyst.

SUMMARY OF THE INVENTION

A process has been invented for the desulfurization and liquefaction of coal which permits the use of inexpensive synthesis gas rather than requiring the use of the more expensive hydrogen and which produces a liquid oil product suitable for use as a fuel oil. By the process of this invention for desulfurizing and liquefying coal, a feed stock of the coal in a liquid slurry is contacted with a treat gas of hydrogen, carbon monoxide and steam, in a reactor, in the presence of a desulfurization catalyst selected from the group consisting of cobalt molybdate supported on alumina, silica-stabilized cobalt molybdate supported on alumina and nickel molybdate supported on alumina and an alkali metal catalyst selected from the group consisting of sodium carbonate, sodium formate and potassium carbonate, at a temperature of 375° to 475° C. and a pressure of 1500 to 5000 psig, whereby the coal is desulfurized and liquefied to a fuel oil product. By the term "fuel oil product" as used in the specification and claims is meant that portion of the product resulting from the desulfurization and liquefaction that is soluble in benzene, and may be either liquid or solid at room temperature. That fraction of the product which is insoluble in benzene will be termed "residue" or "benzene insolubles."

Besides desulfurizing and liquefying coal, the process is also useful for desulfurizing hydrocarbonaceous liquids containing sulfur, such as coal extract, oil extracts from other sources, raw petroleum, petroleum fuel oils and petroleum distillation residuals. If the raw material is a solid such as particulate coal, the feed stock may be formed by slurrying the raw material with a slurry oil or an organic liquid.

A further advantage of the process of this invention is that the hydrogen-to-carbon monoxide ratio of the off-gas leaving the reactor is increased so that the off-gas could be optionally burned as a low-Btu gas or utilized for methane production or methane synthesis.

It is therefore one object of the present invention to provide a process for the desulfurization and liquefaction of coal.

It is another object of the invention to provide a process for the desulfurization of oils extracted from coal and other sources, crude petroleum and distillation residuals.

Finally, it is the object of the invention to provide a process for desulfurization and liquefaction which utilizes synthesis gas or mixtures of hydrogen and carbon monoxide gases rather than hydrogen gas alone.

DESCRIPTION OF THE PREFERRED EMBODIMENT

These and other objects of the invention may be met by contacting, in a reactor, a feed stock of the coal in a slurry liquid having a concentration of 0.43 to 0.55 parts coal per part slurry liquid, with a treat gas of hydrogen, carbon monoxide and steam where the hydrogen is present from 1 to 2 parts per 1 part of carbon monoxide and the steam is present in a ratio of liquid water to feed stock from about 5 to 15 parts per 100 parts feed stock, in the presence of silica-stabilized cobalt molybdate supported on alumina as a desulfurization catalyst and sodium carbonate as an alkali metal catalyst in a concentration of about 0.5 to 2.0 parts per 100 parts of feed stock, at a temperature of 425° to 450° C. and a pressure of 2000 to 4000 psig, whereby the coal is desulfurized and liquefied to a fuel oil product.

When coal is to be desulfurized and liquefied, the particle size may range from 12 to −400 mesh (U.S. Standard Sieve), preferably −200 mesh. The slurrying liquid may be any organic liquid which is stable under the operating conditions or any hydrocarbonaceous liquids similarly employed. Such slurry liquids may include tar, anthracene oil, heavy petroleum oil or product oil prepared from this or similar processes. Coal concentration may vary from 30 to 100 parts per 100 parts slurry liquid, preferably 43 to 55.

The desulfurization catalysts may be alumina impregnated with cobalt and molybdenum or nickel and molybdenum with or without silica, aluminum impregnated singly or with combinations of zinc, tungsten, cobalt, molybdenum, iron and nickel.

Preferred desulfurization catalysts are alumina impregnated with cobalt and molybdenum also containing silicon and alumina impregnated with nickel and molybdenum. These catalysts may be present as pellets in the reactor or they may be crushed and added to the feed stock.

The alkali metal catalysts may be salts such as carbonates, acetates, formates, oxalates and the like of lithium, sodium, potassium, rubidium and cesium. Preferred alkali metal catalysts are sodium carbonate, sodium formate and potassium carbonate. These alkali metal catalysts may be added to the feed stock by dissolving in the slurry oil. Alternatively, the desulfurization catalyst such as cobalt molybdate can be promoted with an alkali metal such as sodium or potassium to permit the use of a single catalyst.

Reaction conditions in the catalytic reactor generally include a temperature of 375° to 475° C., preferably 425° to 450° C., and a pressure of 1500 to 5000 psig, preferably 2000 to 4000 psig.

The treat gas as used in the process comprises hydrogen, carbon monoxide and steam. This process is most useful when a synthesis gas is used, since this synthesis gas is easily obtainable. The hydrogen to carbon monoxide ratio may vary from 0.5:1 to 3:1, preferably from about 1:1 to 2:1. The presence of carbon dioxide and small amounts of hydrocarbons such as methane and ethane are not deleterious to the process but mainly act as diluents. However, if the off-gas from the process of this invention is recycled, it would be advantageous to recover the hydrocarbon gases, since they are more valuable for use elsewhere. Steam will be present in the reactor in amounts corresponding to a ratio of liquid water to the feed stock of from about 5:100 to 15:100 by volume.

The process of the invention can be carried out as a batch process such as in an autoclave or as a continuous process such as in a fixed bed reactor or in a moving bed reactor. In a batch process, the time will vary with the temperature and may range from 2 to about 60 minutes.

While the mechanism of the process of the invention is not specifically known, it is believed that the hydrogenation and desulfurization are catalyzed by cobalt molybdate and the water-gas shift reaction and reduction of coal by carbon monoxide are catalyzed by sodium carbonate. Hydrogen consumed is replenished partly during the hydrogenation by the catalytic reaction of carbon monoxide with water to form hydrogen and, as a result, an effective hydrogenation is accomplished by eliminating large amounts of oxygen in the coal as carbon dioxide rather than as water which consumes more hydrogen.

The following examples are given to illustrate the process of the invention and are not to be taken as limiting the scope of the invention which will be defined by the appended claims.

EXAMPLE I

A feed stock was prepared from −200 mesh Kentucky high volatile B bituminous coal in a carbonaceous liquid prepared by liquefying coal. The feed stock contained 30 parts coal per 100 parts coal-liquid mixture in addition to 5 parts water, 2 parts crushed silica promoted cobalt molybdate catalyst supported on alumina and 1 part sodium carbonate. The reaction was carried out in a 500 cc magnetically stirred autoclave at 450° C. and 3000 psig for 15 minutes. The starting coal contained 16.7% ash and 5.55% sulfur on a dry basis and the vehicle contained 0.17% sulfur. After the above-described treatment, the coal conversion of 88% and the oil yield of 58% were obtained, and the oil product contained 0.13% sulfur. The gas balance in terms of standard cubic feed per pound of moisture- and ash-free coal is: input 34, output 30.3, $H_2$ consumed 3.3, CO consumed 4.4, and $CO_2$ formed 2.8. The $H_2$/CO ratio of the off-gas leaving the reactor increased to 2.9.

EXAMPLE II

Additional experiments were carried out using the general conditions described in Example I. For most of these experiments, hydrogen and synthesis gas with $H_2$:CO ratios of 1:1 and 2:1 were used at initial pressures of 1500 to 1800 psi. Operating pressures ranged from 2400 to 3400 psi at reaction temperatures of 370° to 450° C. and the reaction was maintained for 5 to 60 minutes at the reaction temperature. After the experiment, rapid internal water cooling of the autoclave to ambient temperature was achieved. Total products were filtered at ambient or warmer temperatures to obtain liquid oils. Filter cakes containing residue and water were extracted by benzene. The water was removed by azeotropic distillation, and the remaining oil was recovered by removing the benzene with a rotary vacuum evaporator. Gaseous products were analyzed by mass spectrometry. Data on conversion, oil yield, hydrogen consumption, and carbon dioxide formation, etc., are given as weight-percent based on moisture- and ash-free (maf) coal. The results of these experiments are given in Tables I to III below.

TABLE I

Results of hydrodesulfurization of a hvb bituminous coal containing 4.18% sulfur in a benzene-soluble oil product containing 0.5% sulfur having a kinematic viscosity of 2515 cs at 60° C. in which the water content in the feed stock was varied. (1500 psi initial pressure, 430° C., 30 min.)

| | Synthesis gas ($1H_2$:1CO) | | | | $H_2$ |
|---|---|---|---|---|---|
| Catalyst | $CoMo^1 + Na_2CO_3^1$ | | | | $CoMo^1$ |
| Water added, parts/100 parts feed stock | 0 | 5 | 10 | 15 | 0 |
| Operating pressure, psi | 2500 | 3000 | 3400 | 3800 | 2400 |
| Conversion, percent | 88 | 92 | 92 | 94 | 91 |
| Oil yield, percent | 55 | 62 | 58 | 57 | 62 |
| $H_2$ consumption, percent | 4.6 | 3.0 | 1.5 | 1.2 | 6.0 |
| CO consumption, percent | 50 | 65 | 90 | 94 | — |
| $CO_2$ formation, percent | 46 | 85 | 108 | 113 | 1 |
| $CH_4$ formation, percent | 5.4 | 4.5 | 4.9 | 5.0 | 3.0 |
| S in oil product, percent | .41 | .37 | .29 | .29 | .21 |
| Kinematic viscosity of oil | | | | | |

TABLE I-continued

Results of hydrodesulfurization of a hvb bituminous coal containing 4.18% sulfur in a benzene-soluble oil product containing 0.5% sulfur having a kinematic viscosity of 2515 cs at 60° C. in which the water content in the feed stock was varied. (1500 psi initial pressure, 430° C., 30 min.)

| | Synthesis gas ($1H_2$:1CO) | | | | $H_2$ |
|---|---|---|---|---|---|
| product, cs at 60° C. | 109 | 88 | 57 | 36 | 57 |

[1]Two parts per 100 parts feed stock.
Data are given in weight percent of maf coal.

TABLE II

Results of hydrodesulfurization of an Illinois hvb bituminous coal containing 4.18% sulfur in recycle oil produced at various temperatures. (30 parts coal/70 parts slurry vehicle, 1500 psi initial pressure, 30 min.)

| | Synthesis gas (1:1) | | | $H_2$ | |
|---|---|---|---|---|---|
| Catalyst | CoMo[1] + $Na_2CO_3$[1] | | | CoMo[1] | CoMo[1] |
| Water added, parts/100 parts feed stock | 10 | 10 | 10 | 0 | 0 |
| Temperature, ° C. | 430 | 400 | 370 | 430 | 400 |
| Operating pressure, psi | 3400 | 3400 | 3400 | 2400 | 2400 |
| Conversion, percent | 95 | 92 | 87 | 91 | 86 |
| Oil yield, percent | 58 | 61 | 65 | 62 | 63 |
| $H_2$ consumption, percent | 1.5 | 0.2 | −0.5 | 6 | 4 |
| CO consumption, percent | 90 | 85 | 85 | — | — |
| $CO_2$ formation, percent | 108 | 101 | 103 | 1 | 1 |
| $CH_4$ formation, percent | 4.9 | 3.0 | 2.1 | 3.0 | 1.2 |
| Oil analysis, percent | | | | | |
| C | 87.7 | 86.7 | | 89.0 | 87.4 |
| H | 7.6 | 8.0 | | 7.7 | 8.1 |
| N | 1.4 | 1.5 | | 1.1 | 1.2 |
| S | 0.29 | 0.36 | 0.39 | 0.21 | 0.34 |
| O | 3.0 | 3.4 | | 2.0 | 3.0 |
| Kinematic viscosity, cs at 60° C. | 57 | 148 | 1480 | 57 | 2967 |

[1]Two parts per 100 parts feed stock. Data are given in weight percent of maf coal.

TABLE III

Results of hydrodesulfurization of Kentucky hvb bituminous coal containing 6.67% sulfur in recycle oil at 400° C. (1500 psi initial pressure, 30 min.)

| | Synthesis gas (1:1) | | $H_2$ |
|---|---|---|---|
| Catalyst | CoMo[1] | CoMo[1] + $Na_2CO_3$[1] | CoMo[1] |
| $H_2O$ added, parts/100 parts feed stock | 0 | 10 | 0 |
| Operating pressure, psi | 2400 | 3100 | 2500 |
| Hydrotreating vehicle | | | |
| S in oil product, percent | 0.31 | 0.30 | 0.29 |
| Kinematic viscosity at 60° C. | 411 | 171 | 1079 |
| Hydrotreating coal (coal:vehicle = 1:2.3) | | | |
| S in oil product, percent | 0.30 | 0.30 | 0.33 |
| Kinematic viscosity, cs at 60° C. | 348 | 231 | 2330 |
| Conversion, percent | 83 | 88 | 85 |
| Oil yield, percent | 55 | 60 | 63 |
| $H_2$ consumption, percent | 3.7 | 1.0 | 4.0 |
| CO consumption, percent | 41 | 80 | — |
| $CO_2$ formation, percent | 27 | 91 | 0.6 |
| $CH_4$ formation, percent | 3.0 | 2.8 | 1.2 |

[1]Two parts of pulverized material per 100 parts feed stock. Data are given in weight percent of maf coal.

The consumption of gases in the coal liquefaction reaction was found to vary with reaction variables. In particular the consumption of synthesis gas depends upon $H_2$/CO ratio, amount of water and the alkali metal catalyst because of the concurrent water-gas shift reaction. Table IV shows analysis of off-gas leaving the reactor under various conditions.

TABLE IV

Analyses of off-gases and gas balance. (Coal:vehicle = 30:70, operating pressure = 3000 psi)

| Feed gas | Synthesis gas ($H_2$:CO = 1:1) | | Synthesis gas ($H_2$:CO = 2:1) | | $H_2$ | |
|---|---|---|---|---|---|---|
| Temperature, ° C. | 430 | 450 | 425 | 450 | 425 | 450 |
| Time, min | 30 | 30 | 30 | 15 | 30 | 15 |
| Water added, parts/100 parts feed stock | 5 | 5 | 5 | 5 | | |
| Catalyst | CoMo[1] + $Na_2CO_3$[1] | | CoMo[1] + $Na_2CO_3$[2] | | CoMo[1] | |
| Off-gas analysis, percent | | | | | | |
| $H_2$ | 39.8 | 41.8 | 62.7 | 64.5 | 96.1 | 96.0 |
| $CH_4$ | 3.5 | 4.2 | 1.8 | 2.5 | 1.2 | 1.7 |
| $C_2H_6$ | 1.4 | 1.0 | 0.7 | 1.0 | 0.6 | 0.7 |

TABLE IV-continued

Analyses of off-gases and gas balance. (Coal:vehicle = 30:70, operating pressure = 3000 psi)

| Feed gas | Synthesis gas ($H_2$:CO = 1:1) | | Synthesis gas ($H_2$:CO = 2:1) | | $H_2$ | |
|---|---|---|---|---|---|---|
| CO | 29.3 | 31.5 | 23.4 | 22.5 | | |
| $CO_2$ | 24.4 | 20.5 | 10.1 | 9.5 | 0.2 | 0.1 |
| $H_2/CO$[2] ratio | 1.35 | 1.33 | 2.68 | 2.86 | | |
| Gas balance, scf/lb maf coal | | | | | | |
| Input | 33 | 33 | 34 | 34 | 40 | 40 |
| Output | 27.8 | 27.0 | 31.2 | 30.3 | 32.5 | 32.2 |
| $H_2$ consumed | 5.5 | 6.3 | 3.1 | 3.3 | 8.8 | 9.0 |
| CO consumed | 8.7 | 10.3 | 4.2 | 4.4 | | |
| $CO_2$ formed | 7.2 | 8.2 | 3.2 | 2.8 | | |
| $CO/H_2$ consumption ratio | 1.58 | 1.64 | 1.35 | 1.33 | | |

[1]Two parts per 100 parts feed stock.
[2]One part per 100 parts feed stock.

The significant formation of carbon dioxide indicates that, in the catalytic hydrotreating of coal using synthesis gas, large amounts of the oxygen in coal are removed as carbon dioxide. The $H_2/CO$ ratio of the off-gas leaving the reactor is greater than the feed gas. The total gas consumption and the $CO/H_2$ consumption ratio (scf of CO consumed divided by scf of $H_2$ consumed) are greater with $1H_2/1CO$ synthesis gas than with $2H_2$:1CO synthesis gas. The $H_2$ consumption is greatest when hydrogen is used.

As can be seen from the preceding tables and discussion, low-value high-sulfur bituminous coal can be desulfurized and liquefied by the process of this invention using inexpensive synthesis gas rather than hydrogen. In addition, by this process, total hydrogen consumption is reduced and an off-gas is produced which can be recycled or which can be optionally burned or utilized for further processing.

The embodiments of the invention in which an exclusive property or privilege is claimed are defined as follows:

1. A process for desulfurizing and liquifying coal while increasing the hydrogen to carbon monoxide ratio of the treat off-gas comprising:

heating at 425° to 450° C. under a pressure of 1500 to 5000 psig, a slurry of coal in a slurry liquid selected from the group consisting of tar, anthracene oil, heavy petroleum oils and fuel oil product, and a treat gas of hydrogen, carbon monoxide and steam, said steam being present in the ratio of liquid water to feed stock of about 5:100 to 15:100, in a reactor in the presence of a desulfurizing catalyst selected from the group consisting of cobalt molybdate supported on alumina, silica-stabilized cobalt molybdate supported on alumina, and nickel molybdate supported on alumina, and an alkali metal catalyst selected from the group consisting of sodium carbonate, potassium carbonate and sodium formate, whereby the coal is desulfurized and liquified to a fuel oil product and the ratio of hydrogen to carbon monoxide in the treat off-gas is increased.

2. The process of claim 1 wherein the coal in the feed stock is present in a ratio to the slurry liquid of 30:100 to 100:100 and the treat gas has an initial hydrogen-to-carbon monoxide ratio of 1:1 to 2:1.

3. The process of claim 2 wherein the alkali metal catalyst is present in a ratio to the feed stock of 0.5:100 to 2:100 and the pressure is 2000 to 4000 psig.

4. The method of claim 3 wherein the desulfurization catalyst is cobalt molybdate supported on alumina and the alkali metal catalyst is sodium carbonate.

* * * * *